United States Patent [19]

Kapstad

[11] 3,955,296

[45] May 11, 1976

[54] CLIP FOR SECURING SIGNAGE TO A VARIETY OF SUPPORTS

[76] Inventor: Odd B. Kapstad, 5 Minot Ave., Acton, Mass. 01720

[22] Filed: Dec. 23, 1974

[21] Appl. No.: 535,398

[52] U.S. Cl. ..... 40/11 R
[51] Int. Cl.[2] ..... G09F 3/18
[58] Field of Search ..... 40/11, 23, 10

[56] References Cited

UNITED STATES PATENTS

| | | | |
|---|---|---|---|
| 303,755 | 8/1884 | Schwartz | 40/23 R |
| 2,761,230 | 9/1956 | Finnegan | 4/11 |
| 3,728,806 | 4/1973 | Koistiuk | 40/11 R |

*Primary Examiner*—Louis G. Mancene
*Assistant Examiner*—Wenceslao J. Contreras
*Attorney, Agent, or Firm*—David E. Brook

[57] ABSTRACT

A clip is disclosed which is used to support signage having information thereon. The clip is uniquely designed so that it can be inserted into a standard price-tag display channel such as that used on the edge of supermarket shelves, or alternatively be secured to rod-like supports such as wire, railing, posts, etc. or to a side of cartons.

The clip is continuously formed from resilient sheet material, such as spring steel, into attaching, connecting, release and gripping members which are all generally planar in shape. A continuous nature is obtained by having these members terminate in reverse bends from which the next member extends. A dimension of the attaching member is appropriate for resilient insertion into a display channel and the attaching member also has one or more tongues which extend towards the connecting member to provide means for mounting the clip on rod-like supports or carton sides. The terminating edge of the gripping member coacts with the connecting member to form compressibly releasable securing means for signage inserted between the connecting and gripping members.

8 Claims, 5 Drawing Figures

CLIP FOR SECURING SIGNAGE TO A VARIETY OF SUPPORTS

BACKGROUND OF THE INVENTION

1. Field of the Invention

This invention is in the field of clips for securing signage to various supports.

2. Description of the Prior Art

It is often desirable to attach various types of signage to shelving, posts, rails, wire baskets, cardboard bins, etc. Much information is conveyed in this manner. For example prices charged by supermarkets are most often communicated to purchasers by posting price tags or cards on or near the products marketed. Typically, supermarkets are restricted in the area available for such signage, and it has become customary for them to employ price tag molding or channel along the edges of their shelves for this purpose. Often, however, it is desirable to be able to display relatively large signs, and a standard price tag channel is usually unsuitable for this purpose.

A number of specialized clips have been developed for attaching signage to a price tag channel, and such clips typically have resilient base members or arms suitable for insertion into the protruding edges or flanges of the channel.

One example of such a clip is described in U.S. Pat. No. 3,091,875. This particular clip has a continuous length of resilient material of substantially uniform cross-section forming a first leg adapted to be retained within one of the opposed grooves formed by the opposed flanges of the channel, a second leg extending from the first leg at least a distance whereby the second leg is adapted to protrude out of the groove in which the first leg is retained. A third leg extends from the second leg at an angle and in a direction adapted to extend outwardly from the channel when the support is mounted therein, and a loop is attached to the end of the third leg to support the material to be displayed. A fourth leg extends from the other end of the loop to form an angle with the third leg, and a fifth leg extends at an angle to the fourth leg in a direction adapted to extend within the other groove of the channel. Finally a sixth leg is attached to the end of the fifth leg and extends in a substantially parallel relationship to the first leg but in the opposite direction, the first and sixth legs having at least portions thereof directly opposed. Despite its complexity, this clip has at least one significant disadvantage since the material displayed is positioned in a perpendicular relationship to the shelving. Thus, it extends outwardly from the shelf edge taking up unnecessary space and creating an obstacle to passersby. Other clips described in the Patent literature and designed for insertion into a standard price tag channel also suffer from this same disadvantage. See U.S. Pat. Nos. 3,530,605, 3,711,973 and 3,714,724.

Various clips have been designed, of course, to mount information bearing cards in a parallel relationship to the shelf edge. Examples of two of these are disclosed in U.S. Pat. Nos. 2,761,230 and 3,324,585. A serious disadvantage of these clips, however, is that they are designed to be used only on a pricetag channel and not for mounting on other types of supports. It would be desirable, therefore, to have a clip that could be mounted on such other supports.

SUMMARY OF THE INVENTION

The invention comprises a uniquely designed clip capable of being attached to or mounted on a wide variety of supports. This clip is fabricated from resilient sheet material, such as sheet metal, and is formed continuously into generallyplanar attaching, connecting, release and gripping members. A dimension of the attaching member is suitable for resilient insertion into a standard display channel such as a supermarket price-tag channel. Tongues or other means are also provided on the attaching member to render it capable of being attached to rod-like supports or the sides of cardboard containers.

The attaching member terminates in a first reverse bend from which the connecting member extends at an acute angle with the attaching member. A second reverse bend is used to terminate the attaching member and the release member extends from the reverse bend at an acute angle with the connecting member. The release member also terminates in a third reverse bend from which the gripping member extends, at an acute angle and towards the connecting member. The terminating edge of the gripping member coacts with the connecting member to provide a compressibly releasable securing means for signage inserted in the clip.

Signage can be inserted or removed from a position between the connecting and gripping members by compressing the latter towards the former with finger pressure. When there is no compression applied, the signage is securely locked into the clip.

Because the above-described clip is formed continuously from resilient sheet material, it eliminates sharp edges often present at outer edges of many clips. Additionally, it can be simply and inexpensively fabricated from commonly used materials such as spring steel. Its design permits signage to be posted in a parallel relationship to shelving and its unique locking feature holds signage securely in place without puncturing, tearing or otherwise mutilating the signage. Yet, signage can be easily released from the clip when desired.

Probably the most significant feature of this clip, nevertheless, is the outstanding flexibility it provides in regard to the large variety of supports to which it can be mounted. As mentioned supra, it can be inserted into a standard display channel of the type used in supermarkets, but is can also be mounted on rod-like supports such as posts, rails, wire, etc. as well as on the sides of containers such as cardboard cartons.

DESCRIPTION OF THE PREFERRED EMBODIMENTS

Figure 1:
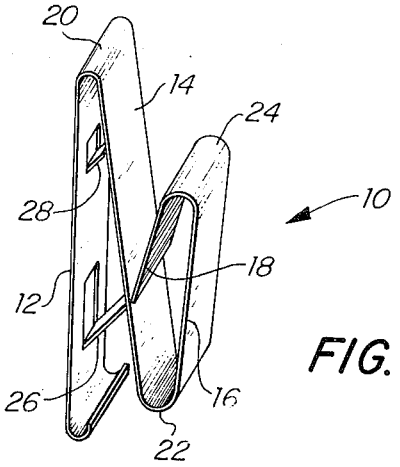
FIG. 1 is a perspective view of a clip as described herein.
Figure 2:
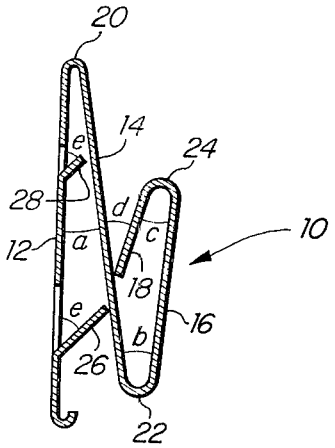
FIG. 2 is a cross-sectional view of a clip as described herein.

Referring now to the Figures in more detail, the construction of a clip according to this invention is illustrated in FIGS. 1 and 2. Clip 10 has four generally-planar members which are attaching member 12, connecting member 14, release member 16 and gripping member 18. Each of these members is continuously formed from resilient sheet material such as sheet metal, with spring steel being a preferred material of construction. A specific example of suitable material is polished stainless spring steel which is about 0.008 inches thick.

Attaching member 12 terminates in a first reverse bend 20 from which connecting member 14 extends at an acute angle a. In similar fashion, connecting member 14 terminates in a second reverse bend 22 from which release member 16 extends at an acute angle b, and release member 16 terminates in a third reverse bend 24 from which gripping member 18 extends at an acute angle c towards connecting member 14. Some latitude is allowable in choosing angles *a*, *b* and *c*. Generally, however, angle a should be between 6° and 12°, angle *b* should be between 12° and 15°, and angle *c* should be between 12° and 15°.

Gripping member 18 forms an acute angle d with connecting member 14 which is critical for proper compressibly releasable securing of signage. The terminating edge of gripping member 18 coacts with connecting member 14 to provide such securing, but if angle *d* is too steep the terminating edge of gripping member 18 tends to dig into signage inserted into the clip rather than releasing it when the clip is compressed. The range of suitable values for angle *d* is determined by the values chosen for angles *b* and *c*. The terminating edge of gripping member 18 preferably touches connecting member 14, so that thin sheets of paper and the like can be secured, but can also be spaced in close proximity thereto as long as the spacing is sufficient to secure signage. To avoid forming an edge on gripping member 18 which would rip and tear signage inserted or removed from clip 10, it is preferred to have the direction of the cutting burr be cut away from connecting member 14.

Tongues 26 and 28 extend from attaching member 12 at an angle 3 towards connecting member 14. These tongues 26 and 28 serve to mount clip 10 to rod-like supports or planar supports. Rod-like supports include rods, posts, wires, railings or any other support having a generally cylindrical shape. Planar supports include carton sides, etc. Although two tongues 26 and 28 are illustrated, this is only for the purpose of providing clip 10 with the flexibility to be mounted on rod-like or planar supports having a variety of diameters or thicknesses and additional or fewer tongues could also be used. Angle e is typically from 40°–50° and preferably 45°.

Signage is inserted into or removed from clip 10 by compressing release member 16 towards connecting member 14 thereby causing the edge of gripping member 18 to move away from connecting member 14. Signage is then inserted between connecting member 14 and gripping member 18. Suitable compression can be achieved by mere application of finger pressure to clip 10. When such compression is removed, the terminating edge of gripping member 18 moves back towards connecting member 14 to releasable secure signage in clip 10. Alternatively, signage can be inserted into clip 10 between attaching member 12 and connecting member 14 when clip 10 is mounted in display channel, etc. This provides the capability to position a sign above or below the display channel.

A dimension of attaching member 12 is designed so that this member can be resiliently inserted into a display channel. Its height, for example, might be close to the distance separating the upper and lower flanges of a display channel so that attaching member 12 can be snapped into such channel. In one embodiment suitable for insertion into a standard supermarket price-tag channel, the height of attaching member 12 is 1⅛ inches.

Figure 3:
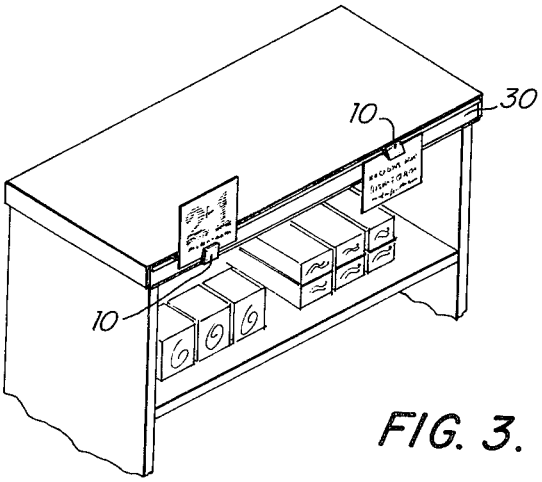
FIG. 3 is a perspective view illustrating a clip as described herein attached to a standard price-tag channel.

In FIG. 3, two clips 10 and 10′ are shown attached to a standard price-tag channel. Clip 10 supports a sign above the shelf whereas the clip 10′ supports a sign below the shelf. Both can be inserted into a standard price-tag channel 30 by applying finger pressure to the ends of attaching member 12 and resiliently snapping it into a position between the upper and lower flanges of channel 30.

Figure 4:
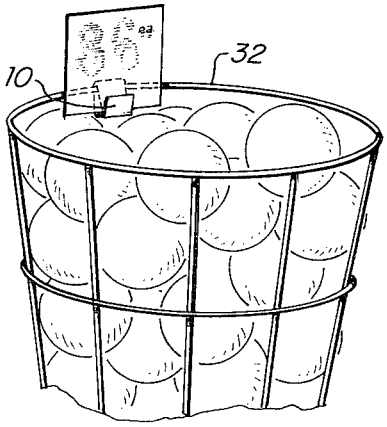
FIG. 4 is a perspective view illustrating a clip as described herein attached to a wire basket.

In FIG. 4, clip 10 is shown supporting signage on a wire basket. Tongues 26 and 28 are employed to mount clip 10 onto the basket by simply forcing the wire past the innermost tongue possible without permanently deforming the tongues. Clip 10 could similarly be attached to other rod-like supports such as posts or rails.

Figure 5:
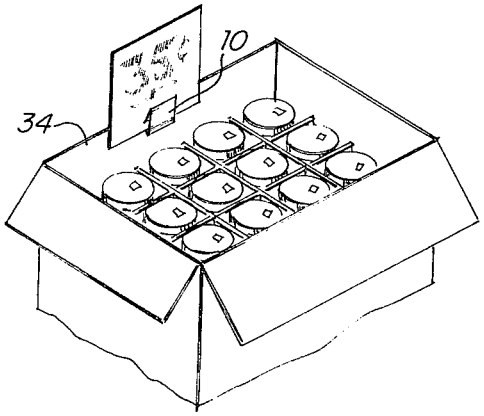
FIG. 5 is a perspective view illustrating a clip as described herein attached to the side of a cardboard container.

Tongues 26 and 28 can also function to anchor clip 10 onto the vertical side of a container such as a cardboard carton. Thus, in FIG. 5, clip 10 is shown attached to one side 34 of a cardboard container. Of course, the clip could be similarly attached to other planar members formed from any material including glass, wood, plastic, etc. The surface of such planar members need not be smooth, and in fact can be wavy, corrugated, knurled, etc.

It will be understood that various other changes in the details, materials, steps and arrangements of parts which have been described and illustrated in order to explain the nature of the invention will occur to and may be made by those skilled in the art upon a reading of this disclosure and such changes are intended to be included within the principle and scope of the invention which is limited only by the claims attached hereto.

What is claimed is:

1. A clip for securing signage to a support, comprising resilient sheet material formed continuously into generally-planar attaching, connecting, release and gripping members, the attaching member having a dimension suitable for resilient insertion into a display channel and having means for mounting the clip on rod-like supports and said attaching member terminating in a first reverse bend from which the connecting member extends at an acute angle with said attaching member, said connecting member terminating in a second reverse bend from which the release member extends at an acute angle with said connecting member, said release member terminating in a third reverse bend from which the gripping member extends at an acute angle with said release member towards said connecting member, the terminating edge of said gripping member coacting with said connecting member to provide releasable securing means whereby signage can be inserted or removed from the clip by compressing said release member toward said connecting member and whereby inserted signage is secured by said clip when said compression is removed.

2. A clip of claim 1 wherein said means for mounting the clip on rod-like supports comprises at least one tongue extending from said attaching member towards said connecting member.

3. A clip of claim 1 wherein said means for mounting the clip on rod-like supports comprises a plurality of tongues extending from said attaching member towards said connecting member.

4. A clip of claim 3 wherein said tongues extend from the attaching member at an angle of from about 40 to about 50 degrees.

5. A clip of claim 4 wherein the edge of said gripping member contacts said connecting member.

6. A clip of claim 1 formed from resilient sheet metal.

7. A clip of claim 5 formed from resilient sheet mtal.

8. A clip of claim 7 wherein said resilient sheet metal is spring steel.

* * * * *